US008651130B2

(12) United States Patent
Ender et al.

(10) Patent No.: US 8,651,130 B2
(45) Date of Patent: Feb. 18, 2014

(54) FLUID SUPPLY

(75) Inventors: Ronald J. Ender, Corvallis, OR (US); Craig L. Malik, Corvallis, OR (US); Norman E. Pawlowski, Corvallis, OR (US); Benjamin Zoladz, Kennewick, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 365 days.

(21) Appl. No.: 13/055,693

(22) PCT Filed: Jul. 1, 2009

(86) PCT No.: PCT/US2009/049416

§ 371 (c)(1),
(2), (4) Date: Jan. 24, 2011

(87) PCT Pub. No.: WO2010/014341

PCT Pub. Date: Feb. 4, 2010

(65) Prior Publication Data

US 2011/0120572 A1 May 26, 2011

Related U.S. Application Data

(60) Provisional application No. 61/083,906, filed on Jul. 26, 2008.

(51) Int. Cl.
*B67D 7/72* (2010.01)

(52) U.S. Cl.
USPC ..... 137/209; 222/94

(58) Field of Classification Search
USPC ..... 137/614–614.05, 207.5, 209; 251/149.1, 149, 149.6, 356; 222/94
See application file for complete search history.

(56) References Cited

U.S. PATENT DOCUMENTS

| | | | | | |
|---|---|---|---|---|---|
| 1,715,335 | A | * | 5/1929 | Cocks | 222/94 |
| 3,270,920 | A | * | 9/1966 | Nessler | 222/94 |
| 3,857,533 | A | * | 12/1974 | Mason | 180/41 |
| 5,014,887 | A | * | 5/1991 | Kopp | 251/354 |
| 5,076,470 | A | * | 12/1991 | Hatakeyama et al. | 222/94 |
| 5,115,944 | A | * | 5/1992 | Nikolich | 222/94 |
| 5,734,401 | A | * | 3/1998 | Clark et al. | 347/85 |
| 5,901,761 | A | * | 5/1999 | Rutter et al. | 137/614.04 |
| 6,151,039 | A | * | 11/2000 | Hmelar et al. | 347/7 |
| 6,322,205 | B1 | * | 11/2001 | Childers et al. | 347/85 |
| 7,174,914 | B2 | * | 2/2007 | Ooishi et al. | 137/614.03 |
| 7,828,173 | B2 | * | 11/2010 | Geier et al. | 222/402.24 |
| 8,240,345 | B2 | * | 8/2012 | Ender et al. | 222/94 |
| 2005/0005995 | A1 | * | 1/2005 | Pericard | 141/20 |
| 2010/0218845 | A1 | * | 9/2010 | Fishman | 141/3 |

FOREIGN PATENT DOCUMENTS

WO WO2004096665 * 11/2004

OTHER PUBLICATIONS

Seaquist Perfect Dispensing, Vertical Aerosol valve, Feb. 28, 1999; Internet search Aug. 7, 2013.*

* cited by examiner

*Primary Examiner* — Craig Schneider
*Assistant Examiner* — Craig J Price

(57) ABSTRACT

A fluid supply includes a container (100, 300) containing a bag (102, 302) and a valve (104, 304).

4 Claims, 5 Drawing Sheets

FLUID SUPPLY

RELATED APPLICATIONS

This application is the national phase of international application No. PCT/US09/49416 filed Jul. 1, 2009, which in turn claims priority of U.S. provisional patent application Ser. No. 61/083,906 filed Jul. 26, 2008.

BACKGROUND

Fluid supplies supply fluid to fluid consuming devices. Connecting and disconnecting such fluid supplies to the fluid consuming devices and expelling fluid from the fluid supply may involve complex, space consuming and expensive components. Providing adequate seals to inhibit drying of the fluid within the fluid supply as well as the fluid receiver may also be difficult, resulting in dried fluid partially occluding fluid passages.

DETAILED DESCRIPTION OF THE EXAMPLE EMBODIMENTS

Figure 1:
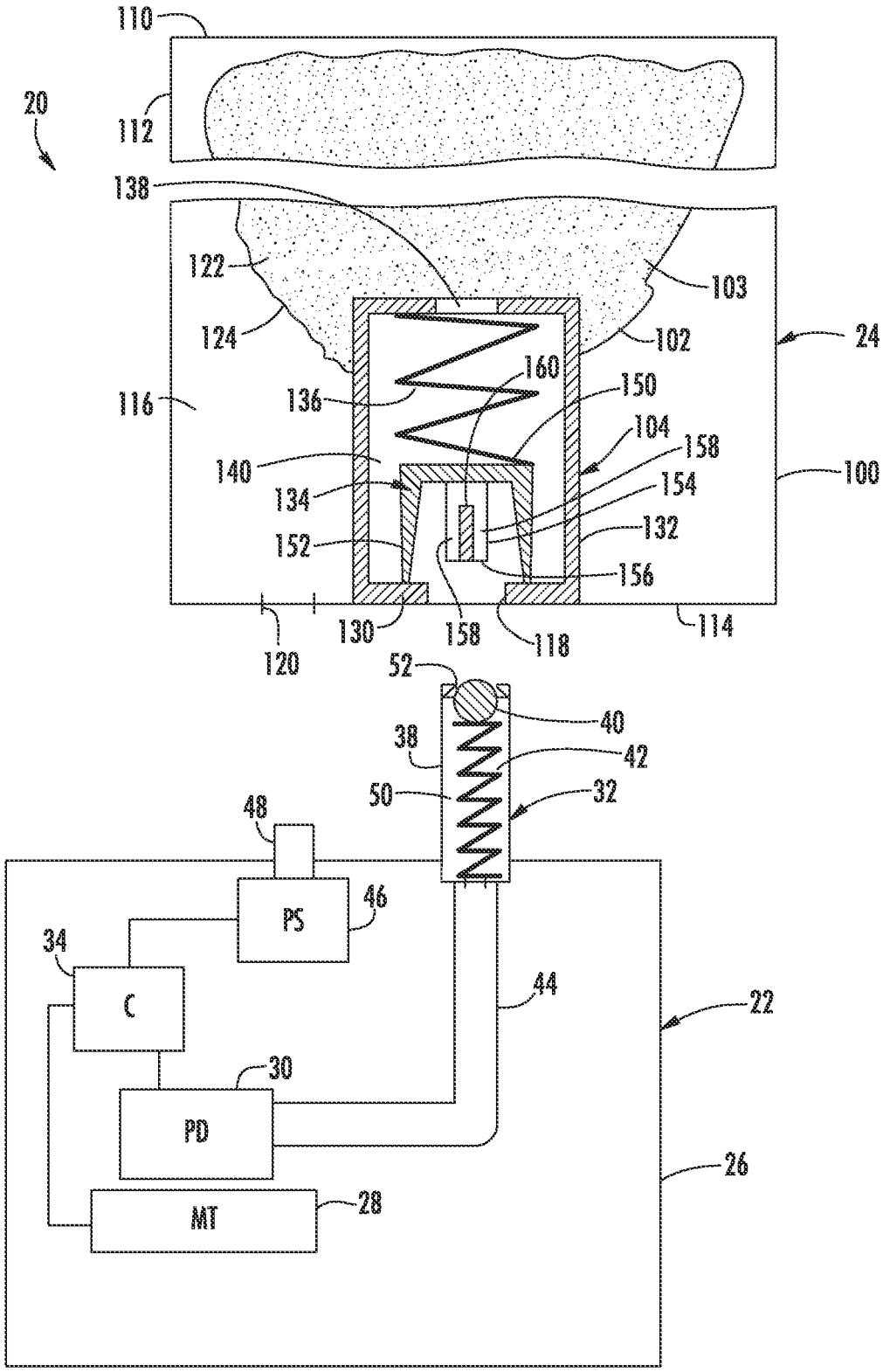
FIG. 1 is a schematic illustration of a fluid supply and receiving system in a disconnected state according to an example embodiment.

FIG. 1 is schematically illustrates fluid supply and receiving system 20 according to an example embodiment. System 20 includes a fluid receiver 22 and a fluid supply 24. As will be described hereafter, fluid supply 24 has a compact arrangement of features for connecting fluid supply 24 to fluid receiver 22 while facilitating reliable fluid seals for both supply 24 and receiver 22 to inhibit drying of fluid within the fluid passages of supply 24 and receiver 22.

FIG. 1 illustrates fluid receiver 22 and fluid supply 24 in disconnected states. Fluid receiver 22 comprises a device configured to receive and consume fluid. In the example illustrated, fluid receiver 22 comprises a printing mechanism or printer. In other embodiments, fluid receiver 22 may comprise other devices that consume fluid in use. Fluid receiver 22 includes housing 26, media transport 28, marking device 30, fluid transmission 32 and controller 34.

Housing 26 comprises a frame, enclosure or other structure configured to support and contain the remaining components of fluid receiver 22. In one embodiment, housing 26 includes a cavity, recess or depression configured to receive or otherwise meet with fluid supply 24. In other embodiments, housing 26 may have other configurations.

Media transport 28 comprises a mechanism configured to transport or move print media relative to marking device 30. In one embodiment, media transport 28 may be configured to transport individual sheets of print media relative to marking device 30. In still other embodiments, media transport 28 maybe configured to transport a substantially continuous web of media to be printed upon by marking device 30. Media transport 28 may utilize rollers, belts, conveyors, one or more drums or other mechanism for transporting such media.

Marking device 30 comprises a device configured to deposit fluid upon media supported by media transport 28. In one embodiment, marking device 30 may comprise one or more drop-on-demand inkjet print heads. Examples of such print heads include thermal inkjet print heads and piezoelectric inkjet print heads. In one embodiment, marking device 30 may scan or reciprocate such print heads back and forth across the media being printed upon. In another embodiment, marking device 30 may extend substantially across a dimension of the media being printed upon, such as with a page-wide-array print device. In yet other embodiments, marking device 30 may comprise other devices which deposit fluid onto a printable substrate. For purposes of this disclosure, a printable substrate or print media is any sheet or web of material upon which a liquid or solution (sometimes referred to as a marking fluid) may be patterned, ejected or otherwise deposited. Such a substrate may comprise a cellulose base material, such as paper, a polymeric based material or other materials such as metals.

In one embodiment, marking device 30 may be configured to deposit one more colors of fluid ink onto the media being printed upon. In yet other embodiments, marking device 30 may be configured to selectively deposit or apply other fluids upon a media or other substrate provided by media transport 28. In embodiments where fluid receiving device 22 does not comprise a printing mechanism, media transport 28 and marking device 30 may be omitted.

Fluid transmission 32 comprises an arrangement of structures or components configured to receive and transmit fluid from fluid supply 24 to marking device 30. In the example illustrated, fluid transmission 32 is further configured to assist in expelling fluid from fluid supply 24. Fluid transmission 32 includes needle 38, valve member 40, bias 42, fluid passage 44, pressure source 46 and pressure interface 48. Needle 38 comprises an elongate post, column, or pin having an interior 50 serving as a fluid passage. Needle 38 and is configured to be inserted into fluid supply 24 during transmission of fluid from fluid supply 24.

As shown by FIG. 1, needle 38 includes an axial opening 52 through which fluid may be transmitted into interior 50. Because opening 52 is an axial opening on an end of needle 38, as compared to a side opening, a fluid connection between the receiver 22 and supply 24 may be achieved in a more compact and less space consuming manner. In particular, the "end" opening 52 reduces an extent to which needle 38 must be inserted into fluid supply 24. In addition, as compared to a side opening, of the "end" opening 52 is more robust with respect to tolerance variability. In other embodiments, needle 38 may include one or more openings or one or more ports at other locations.

Valve member 40 comprises a structure configured to selectively seal or close opening 52 of needle 38. Valve member 52 comprises a ball captured within interior 50 of needle 42 and movable between a closing state (shown in FIG. 1) and an open state withdrawn from opening 52. In other embodiments, valve member 40 may comprise other structures.

Bias 42 comprises a mechanism configured to resiliently bias valve member 40 towards the closing state or sealing position. In the example illustrated, bias 42 comprises a compression spring captured within the interior 50 of needle 38 and urging the ball of valve member 40 into a seated, sealing position across opening 52. In other embodiments, bias 42 may comprise other structures.

Fluid passage 44 comprises a fluid conduit extending from interior 50 of needle 38 to marking device 30. In one embodiment, fluid passage 44 may comprise a flexible tube. In other embodiments, fluid passage 44 may comprise a rigid fluid pipe. Fluid passage 44 may have a variety of different shapes and configurations.

Pressure source 46 comprises a source of pressurized fluid, such as a pressurized gas or pressurized liquid. Pressure source 46 is configured to deliver such pressurized fluid through interface 48 into an interior of fluid supply 24 to assist in expelling fluid from fluid supply 24. In embodiments where other means are used for assisting in the expulsion of fluid from fluid supply 24, pressure source 46 and interface 48 may be omitted.

Controller 34 comprises one or more processing units configured to generate control signals directing the operational media transport 28, marking device 30 and pressure source 46 (when provided). Controller 34 generate such control signals to control the deposition of fluid on media transported by media transport 28. Controller 34 further controls the supply of pressurized fluid by pressure source 46 to at least partially control the rate at which fluid is expelled from fluid supply 24 and received by fluid supply 22.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 34 may be embodied as part of one or more application-specific integrated circuits (ASICs). Unless otherwise specifically noted, the controller is not limited to any specific combination of hardware circuitry and software, nor to any particular source for the instructions executed by the processing unit.

Fluid supply 24 supplies the consumable fluid to fluid receiver 22. Fluid supply 24 includes container 100, bag 102, fluid 103 and valve assembly 104. Container 100 comprises a substantially imperforate vessel configured to contain and enclose bag 102 and valve assembly 104. Container 100 allows fluid or gas to be injected into container 100 about or around bag 102 to force or expel fluid from bag 102. Container 100 includes bottom 110, annular sidewall 112 and top 114. For purposes of this disclosure, the term "annular" encompasses both circular and non-circular rings. In one embodiment, bottom 110 and top 114 are substantially circular while sidewall 112 is substantially cylindrical. In other embodiments, bottom 110, top 114 and sidewall 112 may have other shapes, such as polygonal shapes.

As shown by FIG. 1, bottom 110, sidewall 112 and top 114 cooperate to form or define an interior 116 configured to contain bag 102 and valve assembly 104. Top 114 includes openings 118 and 120. Opening 118 is in fluid communication with an interior of valve simply 104. Opening 118 is sized and shaped so as to receive needle 38 of fluid receiver 22. Opening 118 facilitates fluid flow from bag 102 through needle 38 into fluid receiver 22. In particular circumstances, opening 118 may also be utilized to allow fluid to be supplied into bag 102. In example illustrated, opening 118 is substantially aligned with a centerline or central axis of container 100. In other embodiments, opening 118 may be at other locations.

Opening 120 comprises an aperture in fluid communication with or fluidly coupled to interior 116 of container 100 along an exterior of bag 102. Opening 120 is configured to permit fluid, such as a liquid or a gas, to be injected into interior 116 so as to pressurize the interior 116 so as to expel fluid 103 through valve assembly 104 and opening 118. In the example illustrated, opening 120 is configured to couple with interface 48 of fluid receiver 22. In the example illustrated, opening 120 comprises a female interface configured to removably receive interface 48 which comprises a male interface. In other embodiments, this relationship may be reversed such that interface 48 comprises a female interface, wherein opening 120 is replaced with a male interface. An example illustrated, opening 120 remains in an open state upon withdrawal of interface 48. In other embodiments, openings 120 may be divided with a septum, temporary seal or a valve mechanism so as to be in a closed state prior to initial connection to a fluid receiver 22 for the first time or each time that interface 48 is withdrawn from opening 120.

Bag 102 comprises a flaccid, flexible or collapsible vessel or film configured to contain fluid 103 and to separate or isolate fluid 103 from container 100 within interior 116. Bag 102 has an interior 122 and an exterior 124. Interior 122 is fluidly coupled to or in fluid communication with an interior of valve assembly 104. Likewise, interior 122 is fluidly coupled to opening 118 when valve assembly 104 is in an open state. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. The term "fluidly coupled" shall mean that two are more fluid transmitting volumes are connected directly to one another or are connected to one another by intermediate volumes or spaces such that fluid may flow from one volume into the other volume.

Bag 102 is formed from one or more materials configured to contain fluid 103 while substantially inhibiting permeation of air, fluid or other gases through the walls of bag 102 into the fluid 103 within bag 102. In some embodiments, bag 102 is configured to contain fluid 103 while maintaining fluid 103 in a substantially degassed state Fluid 103 comprises a fluid utilized by fluid receiver 22. In one embodiment, fluid 103 comprises a liquid. In one embodiment where fluid receiver 22 comprises a printing mechanism or system or device, fluid 103 comprises a printing liquid or solution (also known as a marking fluid). In embodiments where text, graphics or other images are to be printed upon a medium, fluid 103 may comprise an ink. For example, fluid 103 may comprise a black ink or one of various colors of ink. In yet another embodiment, fluid 103 may comprise others liquid solutions carrying solutes which are to be patterned upon a substrate by a fluid ejection device.

Valve assembly 104 comprises an assembly or mechanism configured to control the flow of fluid into and/out of interior 122 of bag 102 within container 100. Valve assembly 104 is further configured to interface with needle 38 of fluid receiver 22 to transmit fluid through needle 38 into receiver 22. Moreover, at substantially the same time that valve assembly 104 is actuated to an open state due to its interaction with needle 38, valve assembly 104 substantially concurrently actuates valve member 40 to open state or open position. Consequently, valves of both receiver 22 and supply 24 are concurrently opened to facilitate fluid flow therebetween. Upon disconnection, the valves of both receiver 22 and supply 24 are automatically closed to retain existing fluid within receiver 22 and supply 24 while also inhibiting the drying of such existing fluid. As a result, dried fluid is less likely to occlude fluid passages or interiors of fluid receiver 22 or fluid supply 24.

As shown by FIG. 1, valve assembly 104 includes fluid seal 130, valve body 132, valve stem 134 and bias 136. Fluid seal 130 comprises a gasket, ring or other structure of compressible material extending about opening 118 within an interior 116 of container 100. Fluid seal 130 is configured to cooperate with valve stem 134 to close opening 118 when valve stem 134 is in a closed state. Although seal 130 is disclosed as being compressible, elastomeric or rubber-like while those portions of valve stem 134 that contact seal 130 are substantially rigid, in other embodiments, this relationship may be reversed where seal 130 comprises an annular rigid blade-like member and valve stem 134 includes an elastomeric, compressible, rubber-like mating and sealing structure.

Valve body 132 comprises one or more structures configured to contain the remaining components of valve assembly 104 proximate to opening 118 of container 100. Valve body 132 is substantially imperforate and extends about opening 118 within interior 116 of container 100. Valve body 132 includes a port 138 fluidly connecting interior 122 of bag 102 to an interior 140 of body 132. Port 130 allows fluid 103 to enter interior 140 of body 132.

Valve stem 134 comprises a structure within valve body 132 configured to control the flow of fluid through valve body 132 and to also actuate valve member 40 of fluid receiver 22. Valve stem 134 projects into needle 38 during reception of needle 38 by opening 118 and by valve body 132. Valve stem 134 includes base 150, annular blade 152 and pin 154. Base 150 supports blade 152 and pin 154. Blade 152 projects from base 150 and is configured to contact and sealingly engage with seal 130 when valve stem 134 is moved to a sealing position as shown in FIG. 1. Blade 152 completely extends around pin 154 and completely closes off opening 118 when valve stem 134 is in the sealing position shown.

Pin 154 projects from base 150 and is surrounded by blades 152. Pin 154 is configured to project into interior 50 of needle 38 when needle 38 is inserted through opening 118 into body 132 where it is surrounded by blade 152. Pin 154 is further configured to contact valve member 40 to move valve member 40 against bias 42 from a sealing or closed state or position to an open state or position. In the example illustrated, pin 154 has an axial and or head 156 configured to contact or abut valve member 40 during connection of fluid supply 24 with fluid receiver 22.

In the example illustrated, pin 154 includes flow passages 158 at least partially along its axial length. Flow passages 158 facilitate insertion of pin 154 into interior 50 of needle 38 against valve member 40 and bias 42 while providing a passage through which fluid may flow from the interior 140 of valve body 132 and from bag 102 into interior 50 of needle 38. In one embodiment, flow paths 158 extend along the sides of pin 154. In one embodiment, flow paths 158 are formed by castellations 160 encircling pin 154. In other embodiments, flow paths 158 may be provided at other locations along or through pin 154.

Bias 136 comprises one or more members configured to resiliently urge or bias valve stem 134 towards the closing or sealed position shown in FIG. 1. In the example illustrated, bias 136 comprises a compression spring captured between base 150 of valve stem 134 and valve body 132. The spring of bias 136 has a spring constant such that engagement of pin 38 with valve stem 134 or engagement of valve member 40 with pin 154 will result in compression of bias 136 and movement of valve stem 134 towards bottom 110 to an open position. At the same time, the spring constant of bias 42 with respect to the spring constant of bias 136 is such that engagement of pin 154 against valve member 40 results in compression of bias 42 and movement of valve member 42 and open state. In other embodiments, bias 136 may have other configurations.

Figure 2:
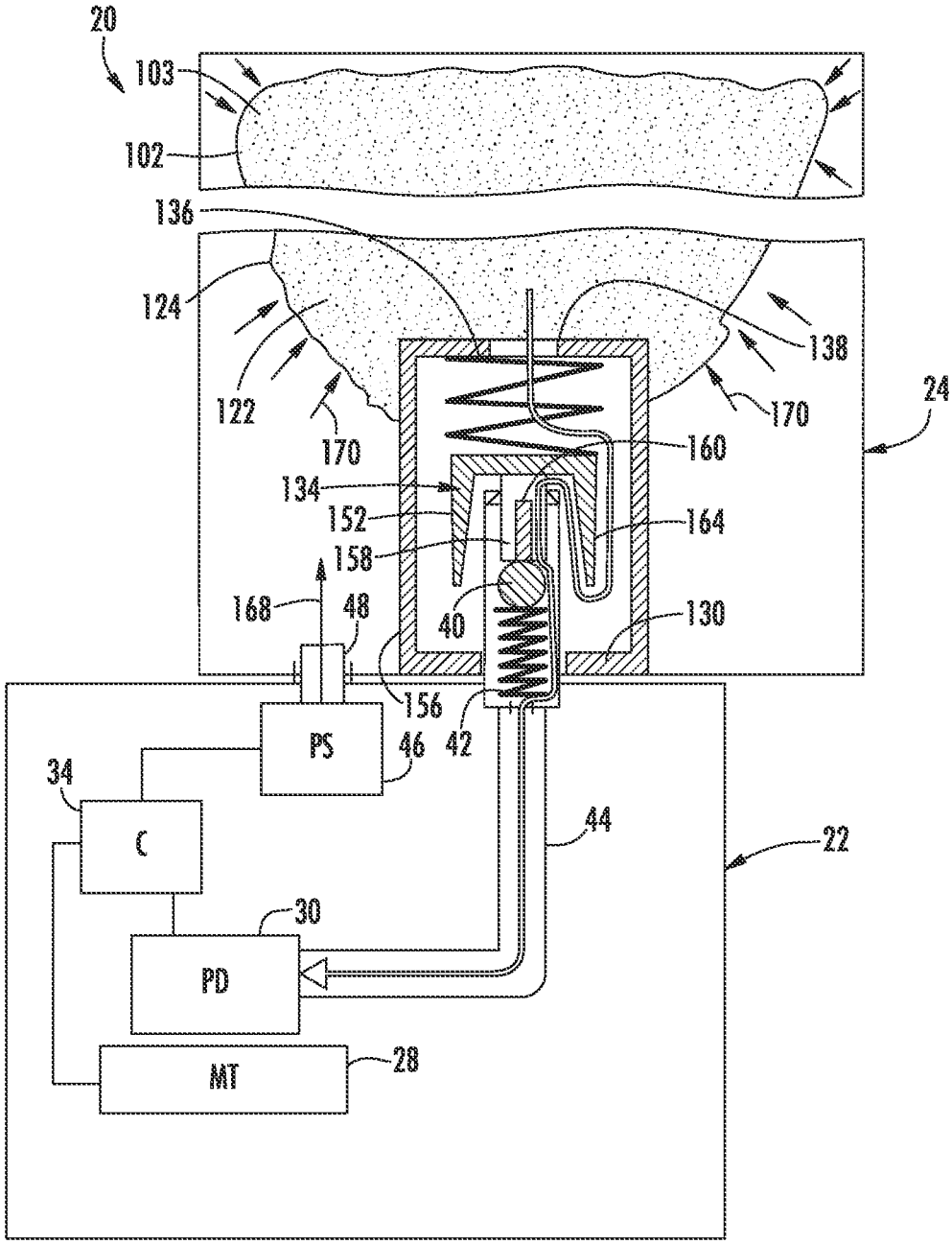
FIG. 2 is a schematic illustration of the fluid supply and receiving system of FIG. 1 and a connected state according to an example embodiment.

FIG. 2 illustrates system 20 way of fluid supply 24 connected to fluid receiver 22. FIG. 2 illustrates the supply of fluid to receiver 22. As shown by FIG. 2, fluid supply 24 is brought into mating, interlocking are coupled relationship with respect to fluid receiver 22. As a result, interface 48 is received through opening 120 to provide communication between pressure source 46 and interior 116 of container 100. This also results in needle 38 being inserted through opening 118. During such insertion of needle 38 through opening 118, seal 130 seals against sides of needle 38. At the same time, pin 154 exerts a force upon valve member 40 to compress bias 42 so as to open opening 52 of needle 38. Valve member 40 and bias 42 also exert force upon pin 154 so as to move valve stem 134 against bias 136 to the open position. As a result, as indicated by arrow 164, a fluid passage is formed from the interior 122 of bag 102 through opening 138 into valve body 132, along flow passages 158 into interior 50 of needle 38 and through fluid passage 44 to marking device 30 (or other fluid consuming devices of receiver 22).

In response to entry of commands from a user or external electronic device or in response to signals from one or more sensors indicating proper connection of fluid supply 24 to receiver 22, controller 34 generates control signals correcting pressure source 46 to supply pressurized fluid to the interior 116 of container 100 as indicated by arrow 168. As indicated by arrows 170, the pressurization of interior 116 exerts a force against exterior 124 of bag 102 to compress or squeeze fluid 103 out of bag 102 and along the aforementioned fluid path. Upon a sufficient volume or amount of fluid being transferred to fluid receiver 22, fluid supply 24 may be disconnected from fluid receiver 22. In response to such disconnection, bias 42 automatically returns valve member 40 to the closed position shown in FIG. 1 and bias 136 automatically returns the valve stem 134 to the closed position shown in FIG. 1.

Figure 3:
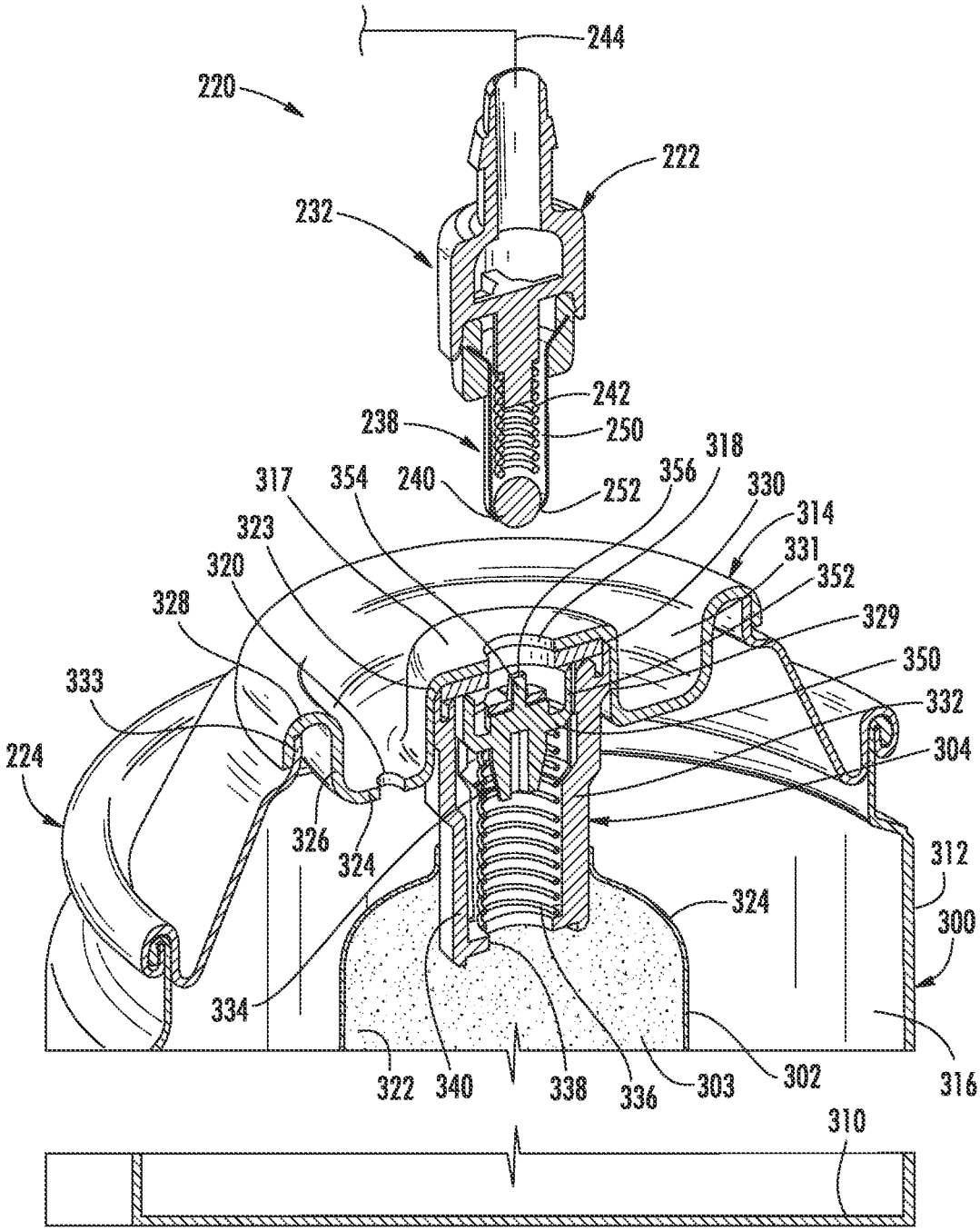
FIG. 3 is a sectional perspective view of another embodiment of the fluid supply and receiving system of FIG. 1 in a disconnected state according to an example embodiment.
Figure 4:
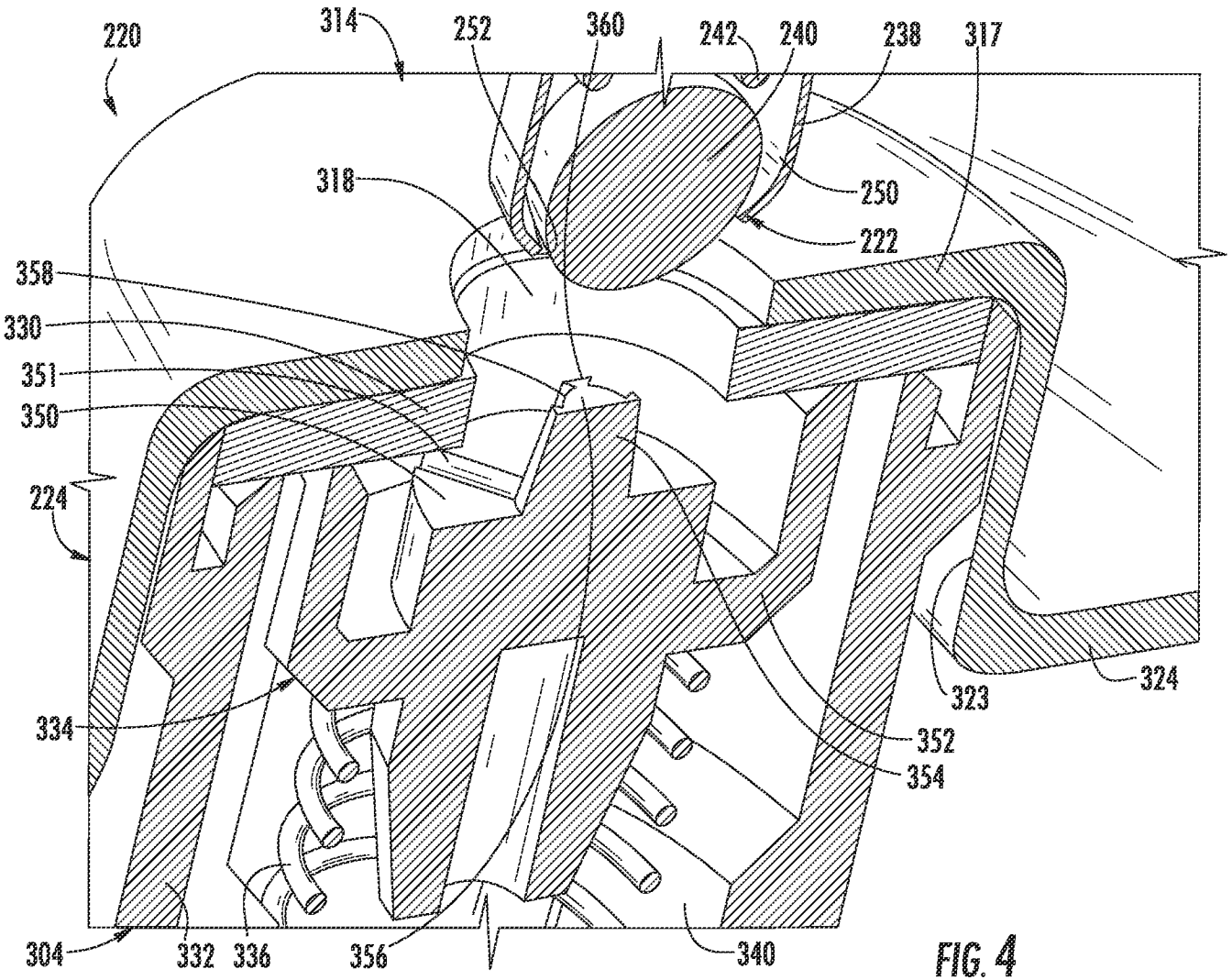
FIG. 4 is an enlarged fragmentary sectional perspective view of the fluid supply and receiving system of FIG. 3 according to an example embodiment.
Figure 5:
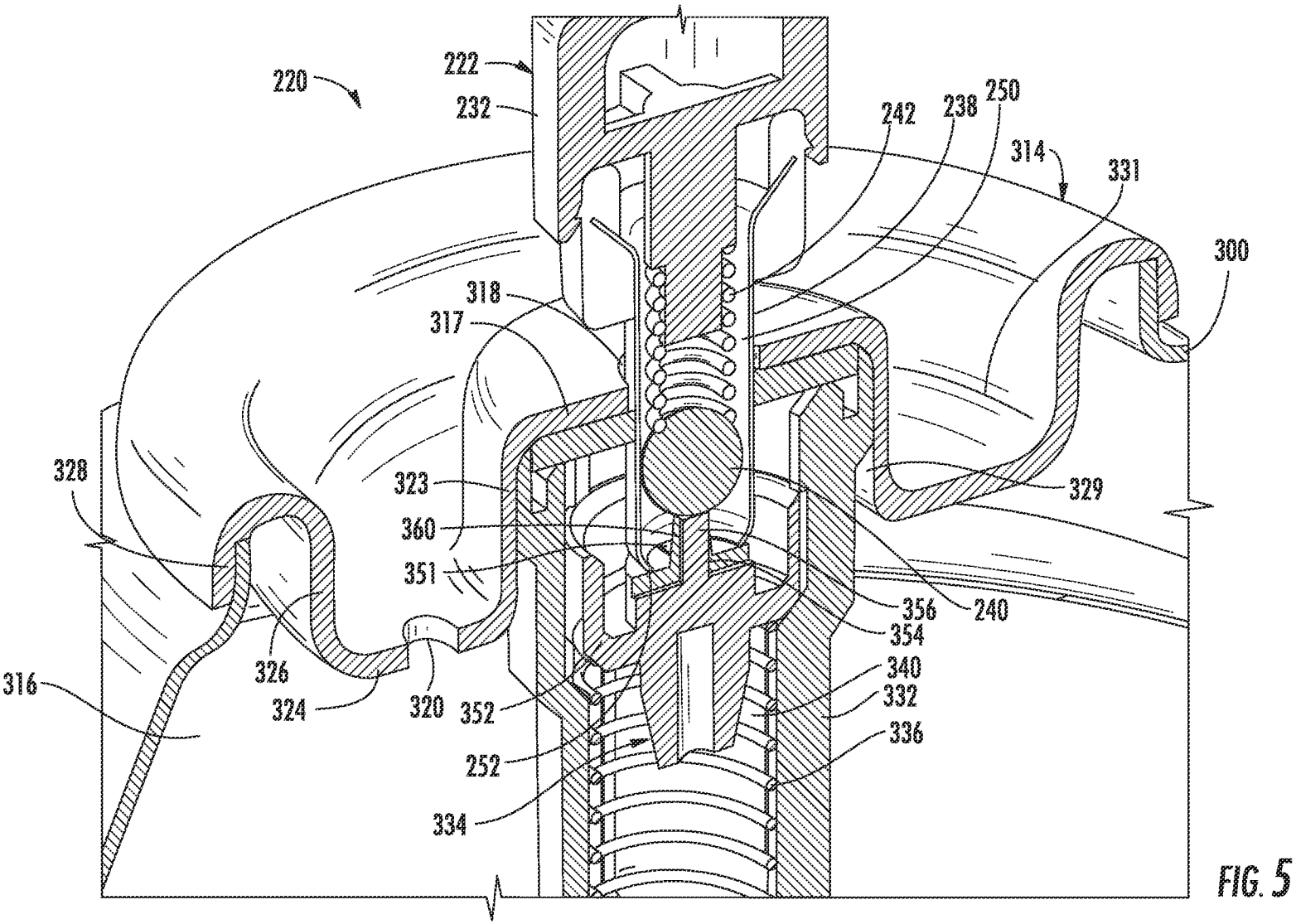
FIG. 5 is an enlarged fragmentary sectional perspective view of the fluid supply and receiving system of FIG. 3 in a connected state according to an example embodiment.

FIGS. 3-5 illustrate fluid supply and receiving system 220, another embodiment of system 20 shown in FIGS. 1 and 2. System 220 is similar to system 20 in that system 220 provides a compact arrangement of features for connecting a fluid supply to fluid receiver while facilitating reliable fluid seals for both the fluid supply and the fluid receiver to inhibit drying of fluid within the fluid passages of the supply and the receiver. As with system 20, system 220 includes a fluid receiver 222 and a fluid supply 224. FIGS. 3 and 4 illustrate fluid receiver 222 and fluid supply 224 in disconnected states. FIG. 5 illustrate fluid receiver to 222 and fluid supply to 224 in a connected state.

Fluid receiver 222 comprises a device configured to receive and consume fluid. In the example illustrated, fluid receiver 222 comprises a printing mechanism or printer. In other embodiments, fluid receiver 222 may comprise other devices that consume fluid in use. Fluid receiver 222 includes housing 26, media transport 28, marking device 30 and controller 34, each of which is shown and described above with respect to FIG. 1. Fluid receiver 222 additionally includes fluid transmission 232 in place of fluid transmission 32.

Fluid transmission 232 comprises an arrangement of structures or components configured to receive and transmit fluid from fluid supply 224 to marking device 30. In the example illustrated, fluid transmission 232 is further configured to assist and expelling fluid from fluid supply 224. Fluid transmission 232 includes needle 238, valve member 240, bias 242, fluid passage 244, pressure source 46 (shown and described with respect to FIG. 1) and pressure interface 48 (shown and described with respect to FIG. 1). Needle 238 comprises an elongate post, column, or pin having an interior 250 serving as a fluid passage. Needle 238 and is configured to be inserted into fluid supply 224 during transmission of fluid from fluid supply 224.

As shown by FIG. 3, needle 238 includes an axial opening 252 through which fluid may be transmitted into interior 250. Because opening 252 is an axial opening on an end of needle 238, as compared to a side opening, a fluid connection between the receiver 222 and supply 224 may be achieved in a more compact and less space consuming manner. In particular, the "end" opening 252 reduces an extent to which needle 238 must be inserted into fluid supply 224. In addition, as compared to a side opening, of the "end" opening 252 is more robust with respect to tolerance variability. In other embodiments, needle 238 may include one or more openings or one or more ports at other locations.

Valve member 240 comprises a structure configured to selectively seal or close opening 252 of needle 238. Valve member 252 comprises a ball captured within interior 250 of needle 238 and is movable between a closing state (shown in FIG. 3) and an open state withdrawn from opening 252 (shown in FIG. 5). In other embodiments, valve member 240 may comprise other structures.

Bias 242 comprises a mechanism configured to resiliently bias valve member 240 towards the closing state or sealing position. In the example illustrated, bias 242 comprises a compression spring captured within the interior 250 of needle 238 and urging the ball of valve member 240 into a seated, sealing position across opening 252. In other embodiments, bias 242 may comprise other structures.

Fluid passage 244 (schematically shown) comprises a fluid conduit extending from interior 250 of needle 238 to marking device 30 (shown in FIG. 1). In one embodiment, fluid passage 244 may comprise a flexible tube. In other embodiments, fluid passage 244 may comprise a rigid fluid pipe. Fluid passage 244 may have a variety of different shapes and configurations.

Fluid supply 224 supplies the consumable fluid to fluid receiver 222. Fluid supply 224 includes container 300, bag 302, fluid 303 (schematically shown) and valve assembly 304. Container 300 comprises a substantially imperforate vessel configured to contain and enclose bag 302 and valve assembly 304. Container 300 allows fluid to be injected into container 300 around or about bag 302 to force or expel fluid from bag 302. Container 300 includes bottom 310, annular sidewall 312 and top 314. In one embodiments, bottom 310 and top 314 are substantially circular while sidewall 312 is substantially cylindrical. In other embodiments, bottom 310, top 314 and sidewall 312 may have other shapes, such as polygonal shapes. As shown by FIG. 3, bottom 310, sidewall 312 and top 314 cooperate to further define an interior 316 configured to contain bag 302 and valve assembly 304.

As shown by FIG. 3, top 314 includes top portion 316, annular walls 322, floor portion 324, annular wall 326 and rim 328. Top portion 316 comprises a substantially planar plateau defining or forming opening 318. Opening 318 is in fluid communication with an interior of valve simply 304. Opening 318 is sized and shaped so as to receive needle 238 of fluid receiver 222. Opening 318 facilitates fluid flow from bag 302 through needle 238 and to fluid receiver 222. In particular circumstances, opening 318 may also be utilized to allow fluid to be supplied into bag 302. In example illustrated, opening 318 is substantially aligned with a centerline or central axis of container 300. In other embodiments, opening 318 may be at other locations.

Wall 323 extends from top portion 317 towards a bottom 310. Wall 323 is substantially annular and cooperates with top portion 317 to form a cup-shaped central portion of top 314 having a depression or cavity 329 which faces an interior of the container and which receives, retains and aligns a portion of valve assembly 304 with opening 318. Floor portion 324 extends outwardly from walls 322. Whereas wall 323 is substantially perpendicular with respect to top portion 317, floor portion 324 is substantially perpendicular with respect to wall 323. Floor portion 324 forms one or more openings 320.

Openings 320 comprise one or more apertures in fluid communication with or fluidly coupled to interior 316 of container 300 along an exterior of bag 302. Opening 320 is configured to permit fluid, such as a liquid or a gas, to be injected into interior 316 so as to pressurize the interior 316 so as to expel fluid 303 through valve assembly 304 and opening 318. In the example illustrated, opening 320 is configured to mate or couple with interface 48 (shown in FIG. 1) of fluid receiver 222. In the example illustrated, openings 320 each comprises a female interface configured to removably receive interface 48 which comprises a male interface. In other embodiments, this relationship may be reversed such that interface 48 comprises a female interface, wherein opening 320 is replaced with a male interface. In the example illustrated, each opening 320 remains in an open state upon withdrawal of interface 48. In other embodiments, openings 320 may be provided with a septum, temporary seal or a valve mechanism so as to be in a closed state prior to initial connection to a fluid receiver 222 for the first time or each time that interface 48 is withdrawn from opening 320.

Wall 326 annually extends around opening 318 and extends from floor portion 324 away from bottom 310. Wall 326 along with floor portion 324 and wall 323 form an annular channel 331 extending about opening 318. Channel 331 strengthens top 314. Channel 331 and further provides a female structure to facilitate alignment of fluid receivers, such as fluid receiver 222 with openings 318 and 320 in top 314. In other embodiment, this channel may be omitted.

Rim 328 extends from wall 326 and wraps around a top portion of an intermediate wall 333 which is itself joined to sidewall of container 300. In one embodiment, rim 328 is outwardly bent and crimped to a remainder of container 300. In other embodiments, rim 328 may be secured to the rest of container 300 in other fashions, such as by welding, bonding, mechanical interlocks and the like. In yet other embodiments, top 314 may alternatively be integrally formed as part of a single unitary body with at least portions of a remainder of container 300.

Bag 302 comprises a flaccid, flexible or collapsible vessel or film configured to contain fluid 303 and to separate or isolate fluid 303 from container 300 within interior 316. Bag 302 has an interior 322 and an exterior 324. Interior 322 is fluidly coupled to or in fluid communication with an interior of valve assembly 304. Likewise, interior 322 is fluidly coupled to opening 318 when valve assembly 304 is in an open state. Bag 302 is formed from one or more materials configured to contain fluid 303 while substantially inhibiting permeation of air, fluid or other gases through the walls of bag 302 into the fluid 303 within bag 302.

Fluid 303 comprises a fluid utilized by fluid receiver 222. In one embodiment, fluid 303 comprises a liquid. In one embodiment where fluid receiver 222 comprises a printing mechanism, fluid 303 comprises a printing fluid or marking fluid. In embodiments where text, graphics or other images are to be printed upon a medium, fluid 303 may comprise a fluid ink. For example, fluid 303 may comprise a black ink are one of various colors of ink. In yet another embodiment, fluid 303 may comprise others liquid solutions carrying solutes which are to be patterned upon a substrate.

Valve assembly 304 comprises an assembly or mechanism configured to control the flow of fluid into and out of interior 322 of bag 302 within container 300. Valve assembly 304 is further configured to interface with needle 238 of fluid receiver 222 to transmit fluid through needle 238 into receiver 222. Moreover, at substantially the same time that valve assembly 304 is actuated to an open state due to its interaction with needle 238, valve assembly 304 substantially concurrently actuates valve member 240 to open state or position. Consequently, valves of both receiver 322 and supply 324 are concurrently opened to facilitate fluid flow therebetween. Upon disconnection, the valves of both receiver 222 and supply 224 are concurrently closed to retain existing fluid within receiver 222 and supply 224 while also inhibiting the drying of such existing fluid. As a result, dried fluid is less likely to occlude fluid passages or interiors of fluid receiver 222 or fluid supply 224.

As shown by FIG. 3, valve assembly 304 includes fluid seal 330, valve body 332, valve stem 334 and bias 336. Fluid seal 330 comprises a gasket, ring or other structure of compressible material extending about opening 318 within an interior 316 of container 300. Fluid seal 330 is configured to cooperate with valve stem 334 to close opening 318 when valve stem 334 is in a closed state. Although seal 330 is disclosed as being compressible, elastomeric or rubber-like while those portions of valve stem 334 that contact seal 330 are substantially rigid, in other embodiments, this relationship may be reversed where seal 330 comprises an annular rigid blade-like member and valve stem 334 includes an elastomeric, compressible, rubber-like mating and sealing structures.

Valve body 332 comprises one or more structures configured to contain the remaining components of valve assembly 304 proximate to opening 318 of container 300. Valve body 332 is substantially imperforate and extends about opening 318 within interior 316 of container 300. Valve body 332 includes a port 338 fluidly connecting interior 322 of bag 302 to an interior 340 of body 332. Port 338 allows fluid 303 to enter interior 340 of body 332.

Valve stem 334 comprises a structure within valve body 332 configured to control the flow of fluid through valve body 332 and to also actuate valve member 240 of fluid receiver 222. Valve stem 334 projects into needle 238 during reception of needle 238 by opening 318 and by valve body 332. Valve stem 334 includes base 350, annular blade 352 and pin 354. Base 350 supports blade 352 and pin 354. Blade 352 projects from base 350 and is configured to contact and sealingly engage with seal 330 when valve stem 334 is moved to a sealing position as shown in FIG. 3. Blade 352 completely extends around pin 354 and completely closes off opening 318 when valve stem 334 is in the sealing position shown.

Pin 354 projects from base 350 and is surrounded by blades 352. Pin 354 is configured to project into interior 250 of needle 238 when needle 238 is inserted through opening 318 into body 332 where it is surrounded by blade 352. Pin 354 is further configured to contact valve member 240 to move valve member 240 against bias 242 from a sealing or closed state or position to an open state or position. In the example illustrated, pin 354 has an axial end or head 356 configured to contact in valve member 240 during connection of fluid supply 224 with fluid receiver 222.

As shown by FIG. 4, in the example illustrated, pin 354 includes flow passages 358 at least partially along its axial length. Flow passages 358 facilitate insertion of pin 354 into interior 250 of needle 238 against valve member 240 and bias 242 while providing a passage through which fluid may flow from the interior 340 of valve body 332 and from bag 302 into interior 250 of needle 238. In one embodiment, flow paths 358 extend along the sides of pin 354. In one embodiment, flow paths 358 are formed by castellations 360 encircling pin 354. In other embodiments, flow paths 358 may be provided at other locations along or through pin 354.

Bias 336 comprises one or more members configured to resiliently urge or bias valve stem 334 towards the closing or sealed position shown in FIG. 3. In the example illustrated, bias 336 comprises a compression spring captured between base 350 of valve stem 334 and valve body 332. The spring of bias 336 has a spring constant such that engagement of needle 238 with valve stem 334 or engagement of valve member 240 with pin 354 will result in compression of bias 336 and movement of valve stem 334 towards bottom 310 to an open position. At the same time, the spring constant of bias 242 with respect to the spring constant of bias 336 is such that engagement of pin 354 against valve member 240 results in compression of bias 242 and movement of valve member 240 to an open state. In other embodiments, bias 336 may have other configurations.

FIG. 5 illustrates system 220 of fluid supply 224 connected to fluid receiver 222. FIG. 5 illustrates the supply of fluid to receiver 222. As shown by FIG. 5, fluid supply 224 is brought into mating, interlocking or coupled relationship with respect to fluid receiver 222. This results in interface 48 being received through opening 320 to provide communication between pressure source 46 (shown in FIG. 1) and interior 316 of container 300. This also results in needle 238 being inserted through opening 318. During such insertion of needle 238 through opening 318, seal 330 seals against sides of needle 238. At the same time, pin 354 exerts a force upon valve member 240 to compress bias 242 so as to open opening 252 of needle 238. Valve member 240 and bias 242 also exert force upon pin 354 so as to move valve stem 334 against bias 336 to the open position. As a result, a fluid passage is formed from the interior 322 of bag 302 through opening 338 into valve body 332, along flow passages 358 into interior 250 of needle 238 and through fluid passage 244 to marking device 30 (or other fluid consuming devices of receiver 222).

In response to entry of commands from a user or external electronic device or in response to signals from one or more sensors indicating proper connection of fluid supply 224 to receiver 222, controller 34 (shown in FIG. 1) generates control signals correcting pressure source 46 to supply pressurized fluid to the interior 316 of container 300. The pressurization of interior 316 exerts a force against exterior 324 of bag 302 to compress or squeeze fluid 303 out of bag 302 and along the aforementioned fluid path. Upon a sufficient volume or amount of fluid being transferred to fluid receiver 222, fluid supply 224 may be disconnected from fluid receiver 222. In response to such disconnection, bias 242 automatically returns valve member 240 to the closed position shown in FIG. 3 and bias 336 automatically returns the valve stem 334 to the closed position shown in FIG. 3.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A fluid supply system comprising:

a fluid supply, including:

a container having a first opening;

a flaccid bag within the container;

a seal about the first opening;

a valve assembly within the container and movable between a closed state in sealing contact with the seal and an open state allowing fluid to enter into an interior of the flaccid bag through the first opening, the valve assembly including a pin; and, a fluid receiver including:

a needle, a valve and a fluid passage;

wherein connection of the fluid supply to the fluid receiver results in the pin being received into the needle to open the valve of the fluid receiver, the pin forming at least one fluid passage from an interior of the pin through the first opening along the pin allowing fluid to pass between the flaccid bag and the fluid passage.

2. The fluid supply system of claim 1, wherein the pin includes external castellations providing the at least one fluid passage.

3. The fluid supply system of claim 1 further comprising a marking fluid within the flaccid bag.

4. The fluid supply system of claim 1, wherein the container further includes an opening in fluid communication with an exterior of the flaccid bag within the container.

* * * * *